US007119269B2

(12) United States Patent
Furuhashi

(10) Patent No.: US 7,119,269 B2
(45) Date of Patent: Oct. 10, 2006

(54) ELECTRONIC MUSICAL INSTRUMENT

(75) Inventor: Tomohiro Furuhashi, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 0 days.

(21) Appl. No.: 11/036,404

(22) Filed: Jan. 14, 2005

(65) Prior Publication Data

US 2005/0155486 A1 Jul. 21, 2005

(30) Foreign Application Priority Data

Jan. 16, 2004 (JP) ..... 2004-008968

(51) Int. Cl.
*G10H 1/32* (2006.01)
*G10H 3/00* (2006.01)

(52) U.S. Cl. ..... 84/744; 84/DIG. 17; 84/177

(58) Field of Classification Search ..... 84/743, 84/744, 746, 177, 180, DIG. 17, 27
See application file for complete search history.

(56) References Cited

U.S. PATENT DOCUMENTS 3,605,543 A * 9/1971 Ohara ..... 84/177
5,312,076 A * 5/1994 Rogov ..... 248/165
5,335,283 A * 8/1994 Torii ..... 381/118
5,789,693 A * 8/1998 Lawson ..... 84/744
6,399,870 B1 * 6/2002 Azima et al. ..... 84/744
6,828,497 B1 * 12/2004 Yataka et al. ..... 84/625
6,916,980 B1 * 7/2005 Ishida et al. ..... 84/743

FOREIGN PATENT DOCUMENTS

JP 2745952 2/1998
JP 2002-244661 A 8/2002

* cited by examiner

*Primary Examiner*—Jeffrey W Donels
(74) *Attorney, Agent, or Firm*—Morrison & Foerster LLP

(57) ABSTRACT

An electronic musical instrument which can be designed compact in longitudinal size and is excellent in acoustic characteristics. A musical instrument main body (1) has at least one keyboard device (12), and left and right lateral side panels (13 and 13'). A musical tone signal is generated by a controller (101) through operation of the keyboard device. The musical tone signal generated by the controller is acoustically converted by at least one speaker (31 or 31'). The musical instrument main body is supported by left and right front legs (2 and 2') in the vicinity of the left and right lateral side panels of the musical instrument main body. An upper part of each front leg is secured to the musical instrument main body, and a lower part thereof extends to a floor surface on which the electronic musical instrument is placed. The speaker is held in a speaker box (3 or 3'). The speaker box serves as a supporting member that supports a rear side part of the musical instrument main body. The speaker box has a lower part extending to the floor surface to serve as a rear leg.

9 Claims, 5 Drawing Sheets

ELECTRONIC MUSICAL INSTRUMENT

BACKGROUND OF THE INVENTION

1. Field of the Invention

The present invention relates to an electronic musical instrument which includes a musical tone signal generating device that generates a musical tone signal in response to performance operators, one or more speakers that convert the musical tone signal generated by the musical tone signal generating device into sound, and front legs that support the main body of the electronic musical instrument in the vicinity of left and right lateral side plates of the main body, and more particularly to an electronic musical instrument suitable for use as an electronic keyboard musical instrument equipped with a keyboard section at the main body thereof.

2. Description of the Related Art

Conventionally, there has been proposed an electronic musical instrument in which the main body of the musical instrument is supported by a plurality of legs. In the musical instrument main body, a performance device (e.g. a keyboard device) equipped with operators such as keys, a frame supporting the operators, a circuit board for detecting operations of various operators, and so forth is disposed on a keybed, and a rear side of the performance device (a side opposite to the player side) is configured as a panel surface on which a display, operating switches, and so forth are disposed. Also electronic keyboard musical instruments have been widely used, in which the musical instrument main body is supported by upright plate-shaped legs disposed at opposite lateral sides thereof, as disclosed in e.g. Japanese Patent No. 2745952 and Japanese Laid-Open Patent Publication (Kokai) No. 2002-244661.

In electronic musical instruments, musical tones are sounded by speakers. In many electronic musical instruments, speakers are accommodated within the musical instrument main body, as disclosed in Japanese Patent No. 2745952, referred to above. The space (volume) within the musical instrument main body, however, is narrow so that good acoustic characteristics cannot be obtained. Therefore, speaker boxes are provided separately from the musical instrument main body, as disclosed in Japanese Laid-Open Patent Publication (Kokai) No. 2002-244661, referred to above.

Even in the case where the speaker boxes are disposed separately from the musical instrument main body, the larger the volume of the speaker boxes, the better acoustic characteristics (particularly, low frequency range sound characteristics). However, if the speaker boxes are simply disposed below the musical instrument main body, as disclosed in Japanese Laid-Open Patent Publication (Kokai) No. 2002-244661, referred to above, the player cannot easily perform foot operations, particularly, pedal operations. Moreover, this disposition gives a feeling of oppression to the player. Furthermore, in keyboard musical instruments, the keyboard has to be disposed at the foremost part of the instrument (toward the player). In addition, if speaker boxes of a larger volume are used and disposed so as not to impose limitations upon the pedal operations, the longitudinal size of the musical instrument has to be necessarily increased, leading to an increased longitudinal size of the musical instrument main body. Consequently, the whole musical instrument becomes large in size so that it cannot be transported with ease, resulting in increased costs. Thus, there is room for improvement in this respect.

SUMMARY OF THE INVENTION

It is an object of the present invention to provide an electronic musical instrument which can be designed compact in longitudinal size and is excellent in acoustic characteristics.

To attain the above object, in a first aspect of the present invention, there is provided an electronic musical instrument comprising a musical instrument main body having at least one performance operator, left and right lateral side panels, and a rear side part, a musical tone signal generating device that generates a musical tone signal through operation of the performance operator, at least one speaker that acoustically converts the musical tone signal generated by the musical tone signal generating device, left and right front legs that support the musical instrument main body in a vicinity of the left and right lateral side panels of the musical instrument main body, respectively, the left and right front legs each having an upper part and a lower part, the upper part being secured to the musical instrument main body, and the lower part extending to a floor surface on which the electronic musical instrument is placed, and a speaker box that holds the speaker therein, the speaker box serving as a supporting member that supports the rear side part of the musical instrument main body, the speaker box having a lower part extending to the floor surface to serve as a rear leg.

With the above construction, the speaker box is configured to serve as a rear leg. Therefore, the speaker box itself can be designed large in vertical size, and hence, even if the speaker box is designed compact in longitudinal size, the volume of the speaker box can be increased, leading to good acoustic characteristics, such as the expansion of a reproducible low frequency range. Thus, an electronic musical instrument can be provided which can be designed compact in longitudinal size and is excellent in acoustic characteristics. Moreover, by designing the speaker box compact in longitudinal size, the resulting electronic musical instrument does not give a feeling of oppression to the player. Further, it is no longer necessary to separately provide rear leg members and lateral side panels serving as legs disposed at the opposite lateral sides of the musical instrument.

To attain the above object, in a second aspect of the present invention, there is provided an electronic musical instrument comprising a musical instrument main body having at least one performance operator, left and right lateral side panels, and a rear side part, a musical tone signal generating device that generates a musical tone signal through operation of the performance operator, left and right speakers that acoustically convert the musical tone signal generated by the musical tone signal generating device, left and right front legs that support the musical instrument main body in a vicinity of the left and right lateral side panels of the musical instrument main body, respectively, the left and right front legs each having an upper part and a lower part, the upper part being secured to the musical instrument main body, and the lower part extending to a floor surface on which the electronic musical instrument is placed, an electrical circuit section-housing part that houses an electrical circuit section including the musical tone signal generating device, a housing box disposed under the electrical circuit section-housing part, left and right speaker boxes that hold therein the left and right speakers, respectively, the housing box being interposed between the left and right speaker boxes, the left and right speaker boxes each serving as a supporting member that supports the rear side part of the musical instrument main body, the left and right speaker boxes each having a lower part extending to the floor surface to serve as a rear leg, and a pedal device that is disposed below the housing box.

With the above construction, the same effects as those of the first aspect of the present invention can be provided. Besides, compared with a conventional musical instrument in which a pedal device is mounted via a rod-like member which is hung down from a location at a long distance from the floor surface (for example, the lower surface of a keybed or a speaker box), the stability of the pedals can be enhanced, and the weight of the electrical circuit section-housing part placed on the housing box further increases the stability, making the pedals easy to operate.

To attain the above object, in a third aspect of the present invention, there is provided an electronic musical instrument comprising a musical instrument main body having at least one performance operator, left and right lateral side panels, and a rear side part, a musical tone signal generating device that generates a musical tone signal through operation of the performance operator, left and right speakers that acoustically convert the musical tone signal generated by the musical tone signal generating device, left and right front legs that support the musical instrument main body in a vicinity of the left and right lateral side panels of the musical instrument main body, respectively, the left and right front legs each having an upper part and a lower part, the upper part being secured to the musical instrument main body, and the lower part extending to a floor surface on which the electronic musical instrument is placed, left and right speaker boxes that hold therein the left and right speakers, respectively, the left and right speaker boxes being spaced from each other and each serving as a supporting member that supports the rear side part of the musical instrument main body, the left and right speaker boxes each having a lower part extending to the floor surface to serve as a rear leg, an electrical circuit section-housing part that houses an electrical circuit section including the musical tone signal generating device, and a bridging member that spans the left and right speaker boxes, the electrical circuit section-housing part being disposed on the bridging member.

With the above construction, the same effects as those of the first aspect of the present invention can be provided. Besides, satisfactory acoustic separation of sounds from the left and right speakers is realized by the existence of the electrical circuit section-housing part. Further, the mass of this part, i.e. the mass of an electrical circuit member such as the musical tone generating device, becomes large, which prevents acoustical interference between sounds from the left and right speakers, leading to improved low frequency range sound characteristics in particular.

To attain the above object, in a fourth aspect of the present invention, there is provided an electronic musical instrument comprising a musical instrument main body having at least one performance operator, left and right lateral side panels, and a rear side part, a musical tone signal generating device that generates a musical tone signal through operation of the performance operator, left and right speakers that acoustically convert the musical tone signal generated by the musical tone signal generating device, left and right front legs that support the musical instrument main body in a vicinity of the left and right lateral side panels of the musical instrument main body, respectively, the left and right front legs each having an upper part and a lower part, the upper part being secured to the musical instrument main body, and the lower part extending to a floor surface on which the electronic musical instrument is placed, left and right speaker boxes that hold therein the left and right speakers, respectively, the left and right speaker boxes being spaced from each other and each serving as a supporting member that supports the rear side part of the musical instrument main body, the left and right speaker boxes each having a lower part extending to the floor surface to serve as a rear leg, a horizontal plate-shaped bridging member that spans the left and right speaker boxes at the lower parts thereof, the bridging member having a lower surface, and pedals for foot operations by a player secured to the lower surface of the bridging member for free swinging motions.

With the above construction, the same effects as those of the first aspect of the present invention can be provided. Besides, since the horizontal plate-shaped bridging member spanning the left and right speakers is disposed at the lower parts of the left and right speakers, and the pedals for foot operations by the player is secured to the lower surface of the bridging member for free swinging motions, the upper parts of the left and right speakers serving as rear legs are necessarily fixed to a part of the musical instrument main body, e.g. the keybed, whereas the lower parts of the speaker boxes are fixedly placed on the floor surface due to the weights of the speaker boxes themselves, and hence the pedals are fixed in place at a location close to the lower parts of the speaker boxes, and hence the pedals are stabilized and can be stably operated. In addition, the mass of parts involving the horizontal plate-shaped bridging member increases, leading to good acoustic separation.

Preferably, the electronic musical instrument comprises an electrical circuit section-housing part placed on the horizontal plate-shaped bridging member.

With the above construction, in addition to the construction according to the fourth aspect, the electrical circuit section-housing part is placed on the horizontal plate-shaped bridging member. As a result, the weight of the electrical circuit member further enhances the stability of the pedals and hence the stability of the entire musical instrument.

Preferably, in the first aspect of the present invention, the upper part of each of the left and right front legs overlaps with a part of the musical instrument main body.

Further preferably, an electronic musical instrument comprises at least one stay having an end thereof secured to the musical instrument main body, and another end thereof secured to the lower part of each of the left and right front legs.

Preferably, in the second aspect of the present invention, an electronic musical instrument comprises a pedal device that is disposed below the housing box.

Preferably, in the third aspect of the present invention, an electronic musical instrument comprises pedals for foot operations by a player secured to the bridging member for free swinging motions.

Preferably, in the fourth aspect of the present invention, an electronic musical instrument comprises pedals for foot operations by a player secured to the lower surface of the bridging member for free swinging motions.

The above and other objects, features, and advantages of the invention will become more apparent from the following detailed description taken in conjunction with the accompanying drawings.

DETAILED DESCRIPTION OF THE PREFERRED EMBODIMENTS

Figure 1B:
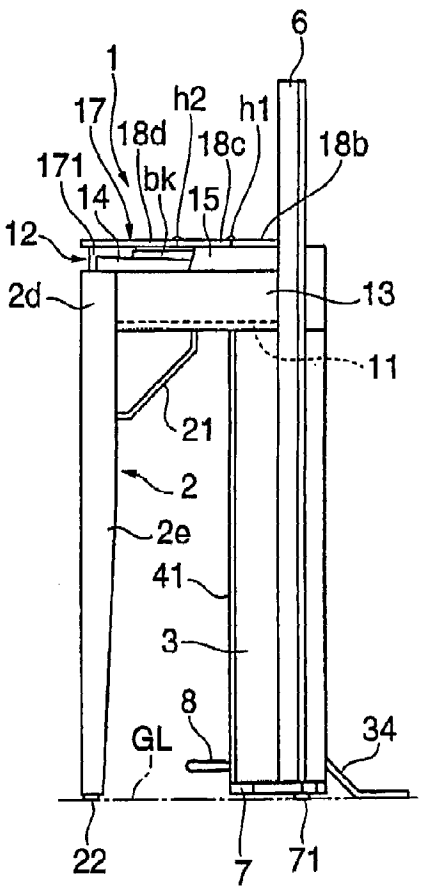
FIG. 1B is a right side view of the electronic musical instrument.

The present invention will now be described in detail with reference to the drawings showing a preferred embodiment thereof. In the drawings, elements and parts which are identical throughout the views are designated by identical reference numeral, and duplicate description thereof is omitted.

In the following description, for component elements each comprised of left and right halves, reference numeral for each of the left halves as viewed from the player is marked by an apostrophe (’), although all of them are not illustrated in the drawings.

Figure 1A:
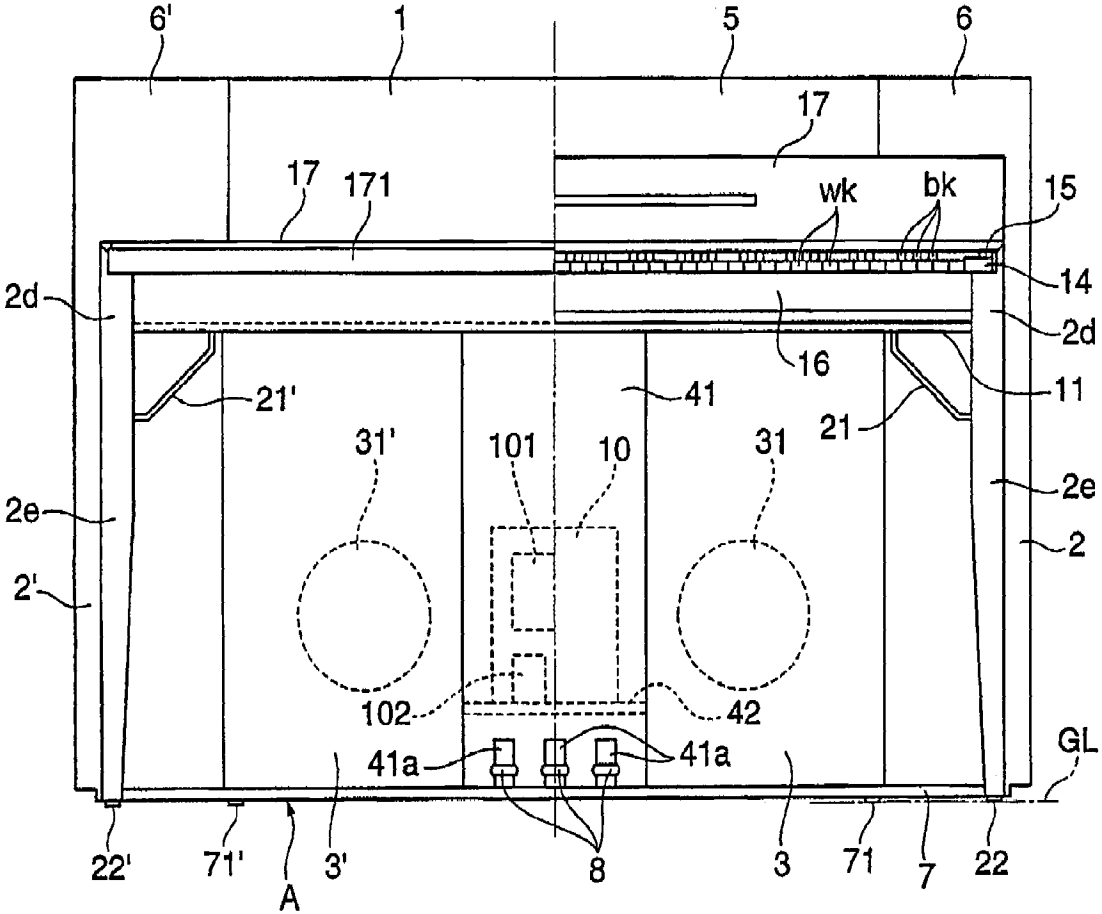
FIG. 1A is a front view showing an electronic musical instrument according to an embodiment of the present invention.
Figure 2A:
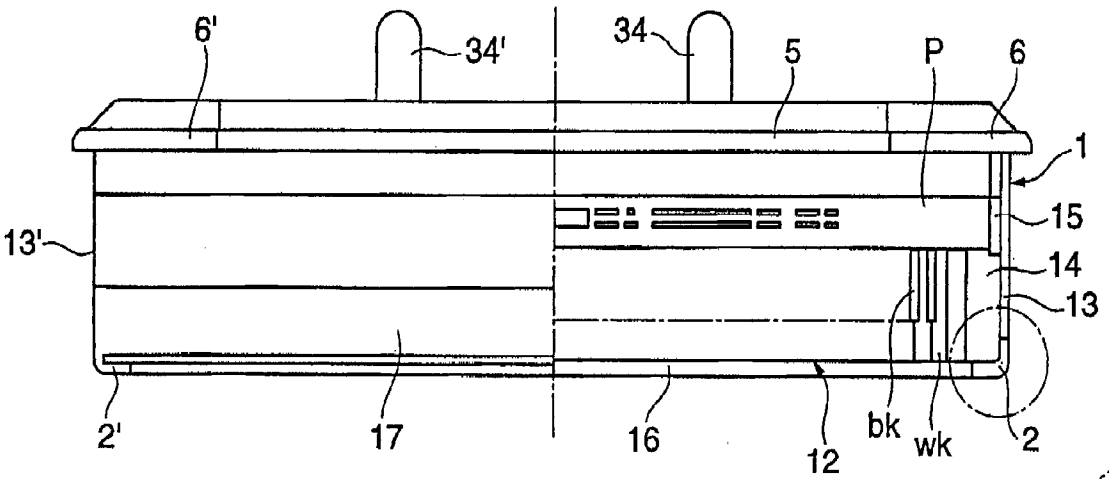
FIGS. 2A and 2B are top plan view of the electronic musical instrument of FIG. 1A.
Figure 2B:
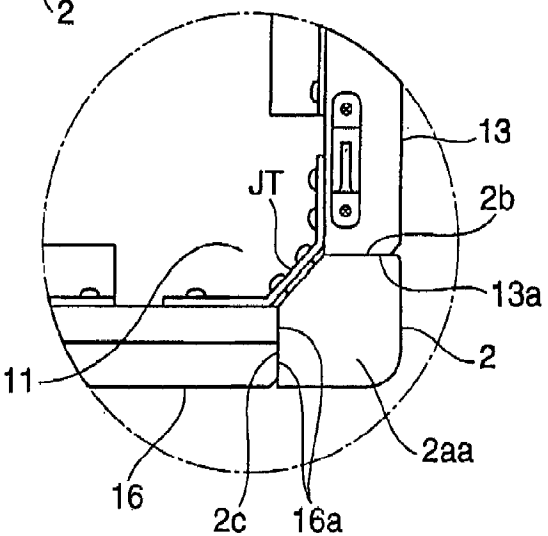
Figure 3:
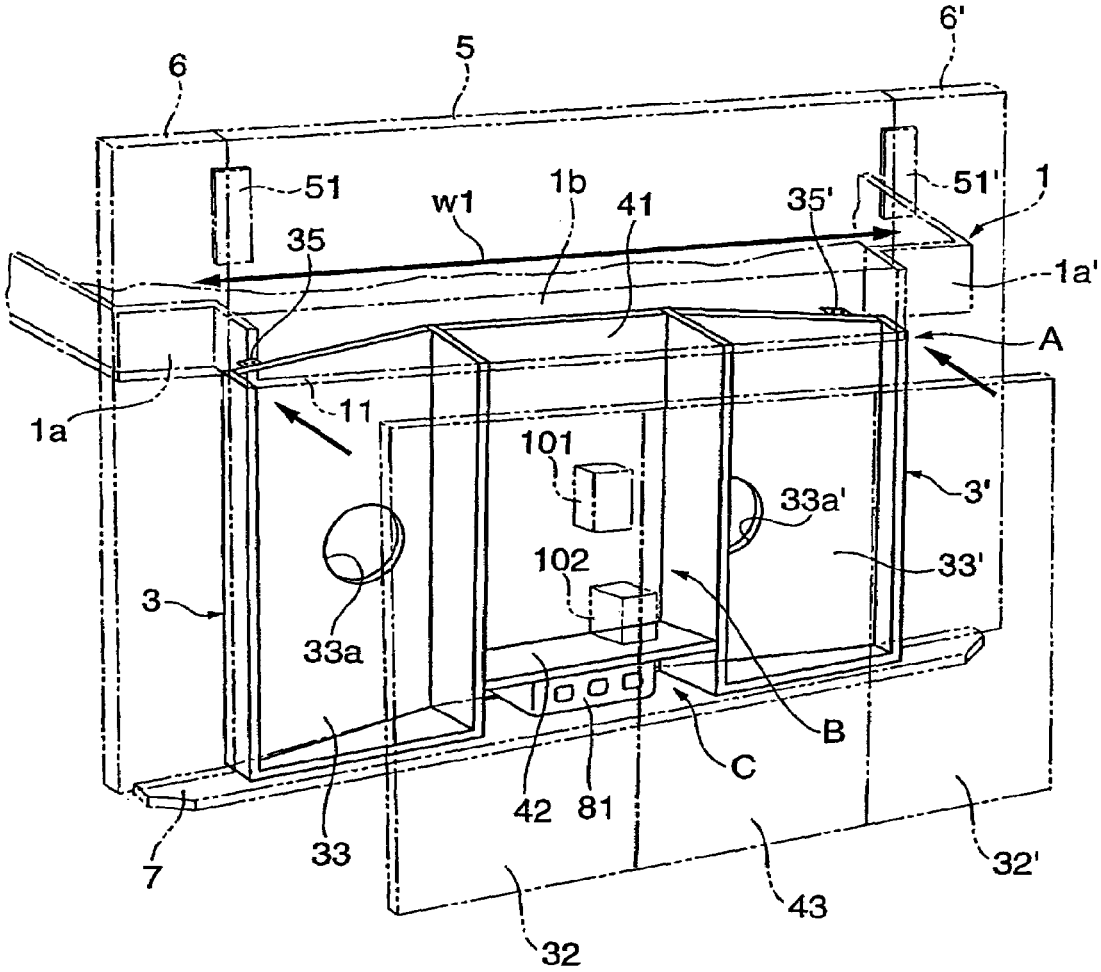
FIG. 3 is a rear side view showing a support member in an exploded state and useful in explaining the positional relationship between various component parts of the whole musical instrument.

FIG. 1A is a front view of an electronic musical instrument according to an embodiment of the present invention. FIG. 1B is a right side view of the electronic musical instrument. FIGS. 2A and 2B are top plan view of the electronic instrument, and FIG. 3 is a rear side view showing a support member appearing in FIG. 1 in an exploded state and useful in explaining the positional relationship between various component parts of the whole musical instrument. The electronic instrument according to the present embodiment is applied to an electronic keyboard musical instrument, such as an electronic piano.

The electronic instrument has a main body 1 which is comprised of a horizontal keybed 11, a keyboard device 12 having a plurality of white keys wk and a plurality of black keys bk as performance operators, and an operating panel P, etc., lateral side panels 13 and 13' covering the left and right sides of the keyboard device 12, sidebeds 14 and 14' disposed at opposite lateral ends of the keyboard device 12 so as to sandwich therebetween the white keys wk, keyboard-covering sideboards 15 and 15' covering left and right sides of the operation panel P of the keyboard device 12, a keyslip part 16 disposed at a front side of the main body 1, and an openable and closeable cover 17 which is disposed on a top side of the electronic instrument main body 1 so as to cover the white keys wk, the black keys bk, the operating panel P, the sidebeds 14 and 14', and the keyboard-covering sideboards 15 and 15'. Reference numeral 171 designates a cover front panel formed integrally with the cover 17 at a front edge thereof and extending along the entire width of the cover 17. FIG. 1A shows a state in which a right half of the cover 17 is open and a left half of the same is closed. FIGS. 2A and 2B show state in which the right side of cover 17 has been removed.

Front legs 2 and 2' that support the musical instrument main body 1 are attached to the musical instrument main body 1 in the vicinity of front ends of the lateral side panels 13 and 13' on both the left and the right sides of the musical instrument main body 1. The right front leg 2 is, as illustrated in the two dotted chain line partial and enlarged portion in FIGS. 2A and 2B, joined to the lateral side panel 13 and the keyslip part 16 via a fastening member JT by means of screws in such a manner that side parts 2*b* and 2*c* of a top part 2*a* of the front leg 2 each contact a front end face 13*a* of the lateral side panel 13 and a right end face 16*a* of the keyslip part 16. Further, the front leg 2 is attached to the musical instrument main body 1 at an intermediate position thereof by a metal stay 21 (FIG. 1) and a metal fixture, not shown, spanning from an inner side face of the front legs 2 to a lower surface of the keybed 11. The front leg 2' is attached to the musical instrument main body 1 in the same manner as the front leg 2, although not illustrated. Also, as shown in FIG. 1, the front legs 2 and 2' extend downward to a floor surface GL. Moreover, casters 22 and 22' are attached to lower end faces of the front legs 2 and 2'.

The front legs 2 and 2' are each comprised of an upper part 2*d* overlapping with the keyslip part 16 and the cover front panel 171 of the cover 17 of the musical instrument main body 1 almost along the whole thickness thereof, and an lower part 2*e* extending downward from the upper part 2*d*. The overlapping of the upper parts 2*d* with the keyslip part 16 and the cover front panel 17 stabilizes or reinforces the front legs 2 and 2' so that the front legs 2 and 2' are not deformed even if an external force is applied thereto. To further reinforce the front legs 2 and 2', the metal stay 21 is bridged between the horizontal keybed 11 and the lower part 2*e*, as mentioned above.

A pair of left and right channel speaker boxes 3 and 3' housing and holding the pair of speakers 31 and 31' are disposed in a rear side part of the musical instrument main body 1. These speaker boxes 3 and 3' extend downward to the floor surface GL to serve as rear legs. Further, back covers 32 and 32' (FIG. 3) are attached to the speaker boxes 3 and 3' at open rear sides thereof. Moreover, the speaker boxes 3 and 3' have baffle boards 33 and 33' having mounting holes 33*a* and 33*a'* formed therein for mounting the speakers 31 and 31'. Disposed between the speaker boxes 3 and 3' are a front plate 41, a horizontal plate-shaped bridging member 42, and a back cover 43 (FIG. 3). The speaker boxes 3 and 3', the back covers 32 and 32', the front plate 41, and the horizontal plate-shaped bridging member 42 are assembled together, thereby constituting the support member A supporting the instrument main body 1. In addition, fall-preventing metal fittings 34 and 34' (FIGS. 1B, 2A and 2B) are detachably attached to the rear side surfaces of the speaker boxes 3 and 3' and extend downward to the floor surface GL.

A rear panel 5 is provided at an upper part of the rear side of the musical instrument main body 1. The rear panel 5 has almost the same width as the support member A. Disposed at opposite lateral sides of the support member A and the rear panel 5 are side rear panels 6 and 6' which are as high as the top end of the rear panel 5. The rear panel 5 and the rear side panels 6 and 6' are fixed together by metal fittings 51 and 51' attached to rear side surfaces of the rear panel 5 and the rear side panels 6 and 6'. Further, the support member A and the rear panel 5 and the side rear panels 6 and 6' are fixed at their lower end edges to an upper surface of an attaching base member 7 that joins these members together. Moreover, casters 71 and 71' (FIG. 1) are attached to a lower surface of the attaching base member 7.

Among the components of the supporting component A, the inside of the front plate 41 serves as an electrical circuit section-housing part B in which an electrical circuit section 10 (FIG. 1) including a controller 101 that generates a musical tone signal in response to the operation of the keyboard device 12 (musical tone signal generating means). Moreover, the controller 101 is implemented by an electrical circuit board that generates a digital musical tone signal by way of such means as a CPU or a sound source chip. Further, the electronic circuit section 10 includes a transformer 102 fixedly placed on the horizontal plate-shaped bridging member 42. The horizontal plate-shaped bridging member 42 has a lower part thereof serving as a housing box C. That is, the electrical circuit section-housing part B rests upon the housing box C. A pedal support frame 81 is housed in the housing box C and mounted on a lower surface of the horizontal plate-shaped bridging member 42. Pedals 8 are secured to the lower surface of the horizontal plate-shaped bridging member 42 for free swinging motions, via the pedal support frame 81. The pedals 8 each have an operating tip passing through an opening 41*a* (FIG. 1A) formed in a lower end of the front plate 41 and exposed toward the player.

Figure 4:
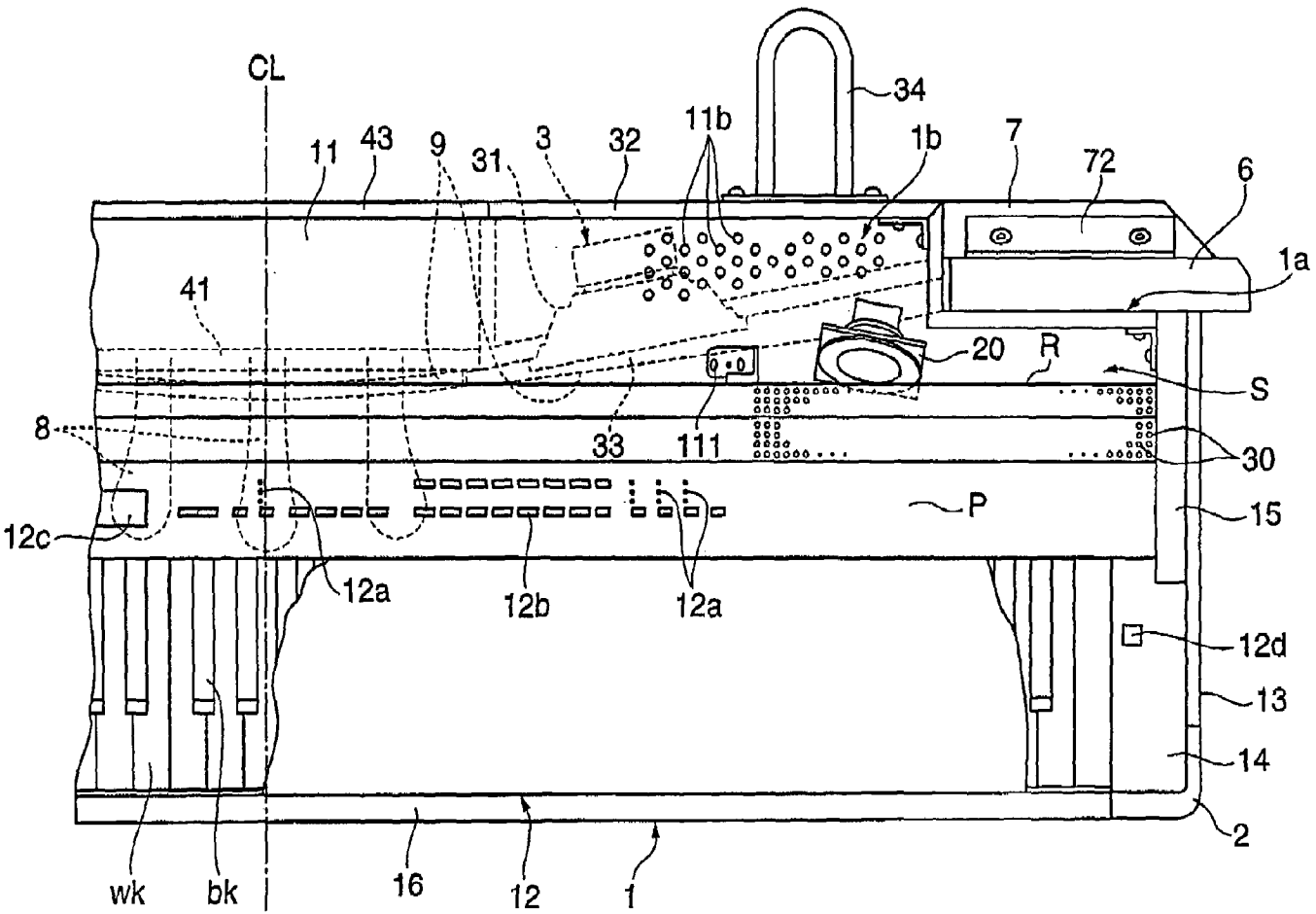
FIG. 4 is a fragmentary top plan view showing a right half of a main body of the musical instrument.
Figure 5:
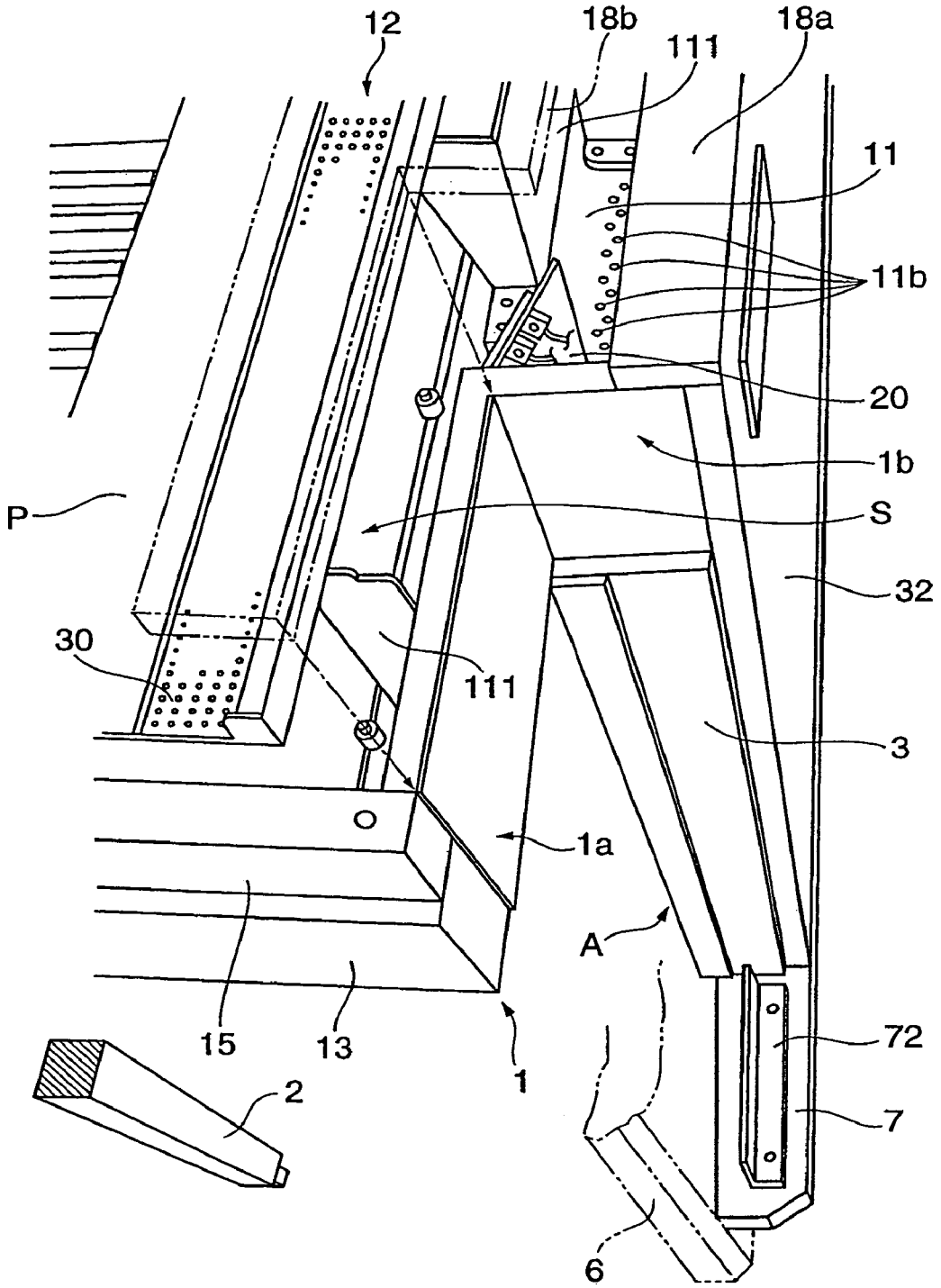
FIG. 5 is a perspective view showing a state in which a right speaker box is attached to the main body of the musical instrument.

FIG. 4 is a fragmentary top plan view showing a right half of the musical instrument main body 1 with a first cover and a second cover removed from the musical instrument main body 1. In FIG. 4, reference symbol CL designates a center line of the musical instrument, and component parts other than detailed parts such as panel switches are arranged substantially in lateral symmetry with respect to the center-line. FIG. 5 is a perspective view showing a state in which the right speaker box 3 is attached to the musical instrument main body 1 with the second cover of the musical instrument main body 1 removed. In the musical instrument main body 1, the operating panel P is secured at a rear side part R thereof to the keybed 11 via supporting metal fittings 111 and at a location slightly lower than the upper end faces of the keyboard-covering sideboards 15.

Further, formed on both sides of a rear part of the musical instrument main body 1 are stepped portions 1*a* and 1*a*' on which the side rear panels 6 and 6' abut. The side rear panels 6 and 6' are fixed at lower ends thereof to the attaching base member 7 by fixing metal fittings 72 and 72'. The rear part of the musical instrument main body 1 has an upper central part inward of the stepped portions 1*a* and 1*a*', which is used as a connecting box-shaped portion 1*b* in the form of a rectangular projection disposed in connection with the speaker boxes 3 and 3'. The connecting box-shaped portion 1*b*, which has a width w1 (FIG. 3) equal to that of the support member A, is fixedly placed on the top of support member A. The instrument main body 1 (keybed 11) and the support member A (speaker boxes 3 and 3') are fixed to each other by means of L-shaped metal fittings 35 and 35' (FIG. 3) fixed to top edges of the speaker boxes 3 and 3'.

Formed in a part of the keybed 11 inside the connecting box-shaped portion 1*b* are a number of through holes 11*b* opening into the inside of the speaker boxes 3 and 3' at a region inside the horizontal sections of the speaker boxes 3 and 3'. Narrow width spaces S and S' are defined between the rear end R of the operating panel P of the keyboard device 12 and the stepped portions 1*a* and 1*a*', and monitor speakers (tweeters) 20 and 20' are disposed in the connecting box-shaped portion 1*b* at sides thereof toward the narrower width spaces S and S'. Tone escape holes 30 comprised of a number of through holes are formed in rear parts of the operating panel P from both the left and right sides of the operating panel P to a central part of the operating panel P inward of the monitor speakers 20 and 20'. The tone escape holes 30 are formed by subjecting a steel plate to pressing and punching when a panel surface of the operating panel P is formed. A first cover 18*a* (FIG. 5) and a second cover 18*b* (indicated by one-dotted chain lines in FIG. 5) are attached to an upper surface of the rear parts of the operating panel P so as to cover the connecting box-shaped portion 1*b* and the narrow width spaces S and S'. The first cover 18*a* and the second covers 18*b* may be formed in one body. A third cover 18*c* and a fourth cover 18*d*, as keyboard covers, are joined to a front end of the second cover 18*b* via a hinge h1 (FIG. 1B). The third cover 18*c* and the fourth cover 18*d* are joined to each other via a hinge h2.

As shown in FIG. 4, LEDs 12*a*, tone color selecting switches 12*b*, and a liquid crystal display device 12*c*, etc. are disposed on the operating panel P. A power switch 12*d* is provided on the sidebed 14. Further, the speaker 31, the baffle board 33, the pedals 8, and the front board 41 are illustrated by dotted lines in FIG. 4. Saran nets 9 are disposed on the front sides of the baffle board 33 and the front board 41.

With the above construction, the musical instrument main body 1 is supported by the two front legs 2 and 2' fixed to the musical instrument main body 1 in the vicinity of the lateral side panels 13 and 13' on both the left and the right sides of the musical instrument main body 1 as well as by the support member A provided at the rear side of the musical instrument main body 1. The speaker boxes 3 and 3' that extend to the floor level themselves have an increased vertical size and therefore have a large vertical volume. As a result, good low frequency range acoustic characteristics can be obtained. Further, sound emitted from the back side of the speakers 31 and 31' is transmitted through the insides of the speaker boxes 3 and 3' to the upper parts thereof, and then guided through the number of through holes 11*b* in the keybed 11 to the connecting box-shaped portion 1*b* of the musical instrument main body 1, wherefrom the sound is released through the narrow width parts S and S' and tone escape holes 30 (the number of through holes) toward the player. Thus, the player can hear well musical tones with good low frequency range sound characteristics. Furthermore, sound from the monitor speaker 20 is also released through the tone escape holes 30, and therefore good middle and high frequency range acoustic characteristics can be obtained.

Moreover, the speaker boxes 3 and 3' are reduced in longitudinal size, so that not only the musical instrument main body 1 but also the entire musical instrument has also a reduced longitudinal size. Thus, an electronic keyboard musical instrument that does not impart a sense of oppression to the player can be provided.

Further, the housing box C upon which the electrical circuit section-housing part B rests is interposed between the speaker boxes 3 and 3', and the pedals 8 are disposed below the housing box C. As a result, the stability of the pedals 8 in the longitudinal direction increases and the pedals 8 can be operated more easily. Specifically, the lower ends of the speaker boxes 3 and 3' are fixed to the floor surface due to the weight of the musical instrument, and accordingly the pedal support frame 81 is fixed in place, and hence the pedals 8 are stabilized. For example, conventional musical instruments include a type in which a rod-like member is hung down from the lower surface of a keybed which is located at a long distance from the floor at a lower part of the musical instrument main body, and a pedal device is attached to a lower end of the rod-like member. However, in the present embodiment, the pedals are more stable in the longitudinal direction than in this conventional arrangement. Moreover, the weight of, for example, the transformer 101 in the electrical circuit section-housing part B placed on the housing box C further enhances the stability of the pedals 8 and hence further enhances the stability of the entire musical instrument.

Further, the horizontal plate-shaped bridging member 42, which spans the speaker boxes 3 and 3', is disposed between the speaker boxes 3 and 3' and at lower parts thereof. The pedals 8 are secured to the lower surface of the horizontal plate-shaped bridging member 42 for free swinging motions, via the pedal support frame 81. Thus, the pedals 8 are fixed to the speaker boxes 3 and 3' at a location close to the lower ends of the speaker boxes 3 and 3'. This obtains good stability of pedal operations.

The disposition of the electrical circuit section-housing part B on the horizontal plate-shaped bridging member 42 can realize satisfactory acoustic separation of sounds from the left and right speakers 31 and 31'. Further, the housing of the electrical circuit section 10 in the electrical circuit section-housing part B increases the mass of the area between the speaker boxes 3 and 3', which prevents acoustical interference between sounds from the left and right speakers 31 and 31', leading to improved low frequency range sound characteristics in particular. Additionally, the lower part of the electrical circuit section-housing part B has an increased weight so that the vector of a force acting upon the support member A (rear legs) to fall down is directed inward (toward the front), and at the same time the center of gravity of the entire musical instrument main body lowers, and accordingly the musical instrument main body cannot easily fall down even though it is thin or compact in longitudinal size.

In the above embodiment, the attaching base member 7 is attached to the bottoms of the speaker boxes 3 and 3'. As a result, the support member A, which is comprised of the speaker boxes 3 and 3', the back covers 32 and 32', the front plate 41, the horizontal plate-shaped bridging member 42, and the back cover 43, has an overall solid and robust structure. The attaching base member 7, however, may be omitted. That is, in the present invention, the construction in which the speaker boxes have lower parts thereof extending downward to the floor to constitute rear legs encompasses both a construction including a member like the attaching base member 7 and a construction not including such a member.

In the above embodiment, the tone escape holes 30 are comprised of a number of through holes. However, tone escape means of any other shape may be employed insofar as it can prevent intrusion of foreign substances, etc. and can enable release of sound to the outside. The tone material of a part in or at which the tone escape means is provided is not limited to a metal, but this part may be molded of a resin in one body with the operating panel P. Further, in the above described embodiment, the sound emitted through the through holes 11*b* formed in the keybed 11 located on the top of the speaker boxes 3 and 3' is released through the tone escape holes 30 toward the player. However, the tone escape holes 30 may be omitted, and instead, a sound-release gap may be formed in communication with the through holes 11*b* at a location above the operating panel P and behind the keyboard device 12 so that the sound from the through holes 11*b* is released toward the player through the sound-release gap. Alternatively, both the tone escape holes 30 and the sound-release gap may be provided to release the sound through both of them.

The sound-release gap may be configured as follows, for example. In the electronic keyboard musical instrument according to the above described embodiment, the first cover 18*a* and the second cover 18*b* that cover parts behind the operating panel P of the musical instrument main body 1 may be modified such that at least the second cover 18*b* is located at a higher level than the upper surface of the operating panel P and a sound-release gap is formed between the second cover 18*b* and the rear side of the operating panel P. In this case, it is advantageous that the operating panel P is extended rearward so as to extend below the second cover 18*b*, and the sound-release gap communicates with the inside of the connecting box-shaped portion 1*b*, for example.

Although the electronic musical instrument of the above embodiment is provided with the monitor speakers 20 and 20', the monitor speakers 20 and 20' may be omitted.

The support member A is trapezoidal in horizontal section and an area corresponding to the height of the trapezoid, that is, the area defined between the front plate 41 and the back cover 43 is used as the electrical circuit section-housing part B. Therefore, the front plate 42 and the back cover 43 extend parallel with each other, and accordingly heat sinks of an amplifier and other component parts of the electrical circuit section 10 can be easily disposed in a space between the front plate 42 and the back cover 43. On the other hand, for example, if the front plate 42 and the back cover 43 do not extend parallel and the space is defined by non-parallel sloping surfaces, heat sinks with different heights have to be arranged in order according to the sloping surfaces. In the above embodiment, this is not necessary.

The support member A, which is trapezoidal in horizontal section, houses heavy electrical parts disposed at the center of the trapezoid and at lower locations of the support member A, so that the center of gravity is located at a central and lower part of the musical instrument main body, which provides stability for the musical instrument main body. Further, the electrical parts are secured to a front one of a pair of parallel surfaces of the trapezoid, which is formed by the front plate 41, which positions the center of gravity further forward, resulting in further increased stability. This can dispense with the use of the fall-preventing metal fittings 34 and 34'.

The rear panel 5 acts to prevent the sound released forward through the narrow width spaces S and S' and the tone escape holes 30 from being radiated rearward, and therefore serves to improve the sound quality. That is, the rear panel 5 also serves as a sound quality-improving member.

The speakers 31 and 31' are disposed on the sloping surfaces of the trapezoid of the support member A, which is trapezoidal in horizontal section, thus presenting a heart shape in which the sounds emitted from the speakers 21 and 21' diverge forward. This enables the present electronic keyboard musical instrument to be used even in a large place such as a stage.

Moreover, in the electronic musical instrument according to the above embodiment, the side rear panels 6 and 6' are detachably secured to the musical instrument main body 1, and therefore the musical instrument main body 1 can be selectively designed according to the user's choice.

Furthermore, in the electronic musical instrument according to the above embodiment, the electrical circuit section 10 is secured to the back cover 43, and therefore a maintenance operation can be easily carried out on the electrical circuit section 10 inside the electrical circuit section-housing part B, merely by removing the front plate 41. If the electrical circuit section 10 is secured to the front plate 41, maintenance can be carried out by removing the back cover 43.

Although in the above embodiment, the front plate 41, the horizontal plate-shaped bridging member 42 and the back cover 43 are interposed as separate members between the speaker boxes 3 and 3'. These members and the speaker boxes 3 and 3' may be formed in one body. Alternatively, a separate box-shaped member may be interposed between the left and right speaker boxes 3 and 3'.

Although in the above embodiment, the casters 71 and 71' are attached to the lower end surface of the attaching base member 7 as floor abutment members, such floor abutment members may be omitted.

Although in the above embodiment, an electronic keyboard musical instrument is given by way of example, the present invention is not limited to an electronic keyboard musical instrument and may be applied to any other type of electronic musical instrument insofar as it is constructed such that a main body thereof is provided with performance operators and musical tones are generated from a speaker or speakers through operations of the performance operators.

What is claimed is:

1. An electronic musical instrument comprising:

a musical instrument main body having at least one performance operator, left and right lateral side panels, a rear side part, a keyslip part having left and right end faces, and a thickness part thereof in a vertical direction, each of said left and right lateral side panels having a front end face;

a musical tone signal generating device that generates a musical tone signal through operation of said performance operator;

at least one speaker that acoustically converts the musical tone signal generated by said musical tone signal generating device;

left and right front legs that support said musical instrument main body in a vicinity of said left and right lateral side panels of said musical instrument main body, respectively, said left and right front legs each having an upper part and a lower part, said upper part having side parts and being secured to said musical instrument main body, and said lower part extending to a floor surface on which the electronic musical instrument is placed; and a speaker box that holds said speaker therein, said speaker box serving as a supporting member that supports said rear side part of said musical instrument main body, said speaker box having a lower part extending to the floor surface to serve as a rear leg, and being trapezoidal in a horizontal section, said speaker being disposed on at least one sloping surface of the trapezoid;

wherein said upper part of each of said left and right front legs overlaps with and is fixed to said thickness part of said musical instrument main body in the vertical direction, and said side parts of said upper part of each of said left and right front legs are joined to the front end face of each of said left and right lateral side panels, and each of the left and right end faces of said keyslip part via a fastening member, respectively.

2. An electronic musical instrument comprising:

a musical instrument main body having at least one performance operator, left and right lateral side panels, a rear side part, a keyslip part having left and right end faces, and a thickness part thereof in a vertical direction, each of said left and right lateral side panels having a front end face;

a musical tone signal generating device that generates a musical tone signal through operation of said performance operator;

left and right speakers that acoustically convert the musical tone signal generated by said musical tone signal generating device;

left and right front legs that support said musical instrument main body in a vicinity of said left and right lateral side panels of said musical instrument main body, respectively, said left and right front legs each having an upper part and a lower part, said upper part having side parts and being secured to said musical instrument main body, and said lower part extending to a floor surface on which the electronic musical instrument is placed;

an electrical circuit section-housing part that houses an electrical circuit section including said musical tone signal generating device;

a housing box disposed under said electrical circuit section-housing part; and left and right speaker boxes that hold therein said left and right speakers, respectively, said housing box being interposed between said left and right speaker boxes, said left and right speaker boxes each serving as a supporting member that is trapezoidal in a horizontal section, and supports said rear side part of said musical instrument main body, said left and right speaker boxes each having a rear side surface, and a lower part extending to the floor surface to serve as a rear leg said left and right speakers being disposed on sloping surfaces of the trapezoid, respectively;

wherein said upper part of each of said left and right front legs overlaps with and is fixed to said thickness part of said musical instrument main body in the vertical direction, and said side parts of said upper part of each of said left and right front legs are joined to the front end face of each of said left and right lateral side panels, and each of the left and right end faces of said keyslip part via a fastening member, respectively.

3. An electronic musical instrument comprising:

a musical instrument main body having at least one performance operator, left and right lateral side panels, a rear side part, a keyslip part having left and right end faces, and a thickness part thereof in a vertical direction, each of said left and right lateral side panels having a front end face;

a musical tone signal generating device that generates a musical tone signal through operation of said performance operator;

left and right speakers that acoustically convert the musical tone signal generated by said musical tone signal generating device;

left and right front legs that support said musical instrument main body in a vicinity of said left and right lateral side panels of said musical instrument main body, respectively, said left and right front legs each having an upper part and a lower part, said upper part having side parts and being secured to said musical instrument main body, and said lower part extending to a floor surface on which the electronic musical instrument is placed;

left and right speaker boxes that hold therein said left and right speakers, respectively, said left and right speaker boxes being spaced from each other and each serving as a supporting member that is trapezoidal in a horizontal section, and supports said rear side part of said musical instrument main body, said left and right speaker boxes each having a rear side surface, and a lower part extending to the floor surface to serve as a rear leg, said left and right speakers being disposed on sloping surfaces of the trapezoid, respectively;

an electrical circuit section-housing part that houses an electrical circuit section including said musical tone signal generating device; and a bridging member that spans said left and right speaker boxes, said electrical circuit section-housing part being disposed on said bridging member;

wherein said upper part of each of said left and right front legs overlaps with and is fixed to said thickness part of said musical instrument main body in the vertical direction, said side parts of said upper part of each of said left and right front legs are joined to the front end face of each of said left and right lateral side panels, and each of the left and right end faces of said keyslip part via a fastening member, respectively, and when said electrical circuit section-housing part houses an electrical circuit section, the center of gravity of said musical instrument main body is positioned in a lower part so that said musical instrument main body is not easily capable of falling down.

4. An electronic musical instrument comprising:

a musical instrument main body having at least one performance operator, left and right lateral side panels, a rear side part, a keyslip part having left and right end faces, and a thickness part thereof in a vertical direction, each of said left and right lateral side panels having a front end face;

a musical tone signal generating device that generates a musical tone signal through operation of said performance operator;

left and right speakers that acoustically convert the musical tone signal generated by said musical tone signal generating device;

left and right front legs that support said musical instrument main body in a vicinity of said left and right lateral side panels of said musical instrument main body, respectively, said left and right front legs each having an upper part and a lower part, said upper part having side parts and being secured to said musical instrument main body, and said lower part extending to a floor surface on which the electronic musical instrument is placed;

left and right speaker boxes that hold therein said left and right speakers, respectively, said left and right speaker boxes being spaced from each other and each serving as a supporting member that is trapezoidal in a horizontal section, and supports said rear side part of said musical instrument main body, said left and right speaker boxes each having a rear side surface, and a lower part extending to the floor surface to serve as a rear leg, said left and right speakers being disposed on sloping surfaces of the trapezoid, respectively; and a horizontal plate-shaped bridging member that spans said left and right speaker boxes at the lower parts thereof, said bridging member having a lower surface;

wherein said upper part of each of said left and right front legs overlaps with and is fixed to said thickness part of said musical instrument main body in the vertical direction, and said side parts of said upper part of each of said left and right front legs are joined to the front end face of each of said left and right lateral side panels, and each of the left and right end faces of said keyslip part via a fastening member, respectively.

5. An electronic musical instrument comprising:

a musical instrument main body having at least one performance operator, left and right lateral side panels, and a rear side part;

a musical tone signal generating device that generates a musical tone signal through operation of said performance operator;

left and right speakers that acoustically convert the musical tone signal generated by said musical tone signal generating device;

left and right front legs that support said musical instrument main body in a vicinity of said left and right lateral side panels of said musical instrument main body, respectively, said left and right front legs each having an upper part and a lower part, said upper part being secured to said musical instrument main body, and said lower part extending to a floor surface on which the electronic musical instrument is placed;

left and right speaker boxes that hold therein said left and right speakers, respectively, said left and right speaker boxes being spaced from each other and each serving as a supporting member that supports said rear side part of said musical instrument main body, said left and right speaker boxes each having a lower part extending to the floor surface to serve as a rear leg;

a horizontal plate-shaped bridging member that spans said left and right speaker boxes at the lower parts thereof, said bridging member having a lower surface; and an electrical circuit section-housing part that is placed on said horizontal plate-shaped bridging member.

6. An electronic musical instrument as claimed in claim 1, wherein said musical instrument main body is comprised of a horizontal keybed, said electronic musical instrument further comprising at least one stay having an end thereof secured to said horizontal keybed of said musical instrument main body, and another end thereof secured to said lower part of each of said left and right front legs.

7. An electronic musical instrument as claimed in claim 2, comprising a pedal device that is disposed below said housing box.

8. An electronic musical instrument as claimed in claim 3, comprising pedals for foot operations by a player secured to said bridging member for free swinging motions.

9. An electronic musical instrument comprising:

a musical instrument main body having at least one performance operator, left and right lateral side panels, and a rear side part;

a musical tone signal generating device that generates a musical tone signal through operation of said performance operator;

left and right speakers that acoustically convert the musical tone signal generated by said musical tone signal generating device;

left and right front legs that support said musical instrument main body in a vicinity of said left and right lateral side panels of said musical instrument main body, respectively, said left and right front legs each having an upper part and a lower part, said upper part being secured to said musical instrument main body, and said lower part extending to a floor surface on which the electronic musical instrument is placed;

left and right speaker boxes that hold therein said left and right speakers, respectively, said left and right speaker boxes being spaced from each other and each serving as a supporting member that supports said rear side part of said musical instrument main body, said left and right speaker boxes each having a lower part extending to the floor surface to serve as a rear leg;

a horizontal plate-shaped bridging member that spans said left and right speaker boxes at the lower parts thereof, said bridging member having a lower surface; and pedals for foot operations by a player that is secured to the lower surface of said bridging member for free swinging motions.

* * * * *